US005447795A

United States Patent [19]

Pohn et al.

[11] Patent Number: 5,447,795

[45] Date of Patent: Sep. 5, 1995

[54] DEVICE FOR THE LAYING OF YARN ON A CROSS-WOUND BOBBIN

[75] Inventors: Romeo Pohn, Ingolstadt; Siegmar Braun, Walting/Pfalzpaint, both of Germany

[73] Assignee: Rieter Ingolstadt Spinnereimaschinenbau AG, Ingolstadt, Germany

[21] Appl. No.: 100,558

[22] Filed: Jul. 30, 1993

[30] Foreign Application Priority Data

Aug. 19, 1992 [DE] Germany ..... 42 27 313.7

[51] Int. Cl.[6] ..... D02G 3/00

[52] U.S. Cl. ..... 428/377; 428/222; 428/367; 428/398; 428/902; 273/81.5; 156/180

[58] Field of Search ..... 428/357, 398, 365, 34.7, 428/222, 35.7, 397, 36.1, 37, 377, 367; 43/18.5; 273/80 B, 81.5; 156/180; 57/58.61, 62, 313

[56] References Cited

U.S. PATENT DOCUMENTS

| | | | |
|---|---|---|---|
| 3,813,098 | 5/1974 | Fisher et al. | 273/72 R |
| 3,881,522 | 5/1975 | Lewis et al. | 138/144 |
| 4,020,202 | 4/1977 | Kreft | 428/33 |
| 4,061,806 | 12/1977 | Liudler et al. | 428/35 |
| 4,063,838 | 12/1977 | Michael | 403/343 |
| 4,135,035 | 1/1979 | Brauey et al. | 428/377 |
| 4,266,734 | 5/1981 | Raasch | 242/18 |
| 4,497,866 | 2/1985 | Petterson et al. | 428/365 |
| 4,555,113 | 11/1985 | Shimazaki et al. | 273/80 B |
| 4,580,737 | 4/1986 | Schmid | 242/35.5 R |
| 4,685,236 | 8/1987 | May | 42/76.02 |

FOREIGN PATENT DOCUMENTS

| | | |
|---|---|---|
| 2632014 | 1/1978 | Germany . |
| 3434027A1 | 3/1986 | Germany . |
| 3812493A1 | 10/1989 | Germany . |

*Primary Examiner*—Patrick J. Ryan
*Assistant Examiner*—Merrick Dixon
*Attorney, Agent, or Firm*—Dority & Manning

[57] ABSTRACT

The invention relates to a yarn guidance rod 1 and to a device for the laying of a yarn on a cross-wound bobbin in a textile machine 8.

A plurality of winding stations installed next to each other is serviced by a yarn guidance rod made of a carbon fiber reinforced plastic which can be moved back and forth. The yarn guidance rod 1 is provided with a sheathing 3. The yarn guidance rod 1 has segments made of a highly heat-expandable material in order to achieve heat compensation.

6 Claims, 2 Drawing Sheets

DEVICE FOR THE LAYING OF YARN ON A CROSS-WOUND BOBBIN

The instant invention relates to a device according to the introductory clause of claims 1 and 4.

Yarn guidance rods made of high-strength plastics are known from DE 33 45 743 A1, but according to this disclosure their surfaces are not entirely plane, this being caused by manufacturing conditions. For this reason difficulties arise in the axial guidance of the yarn guidance rod. It is therefore proposed in this disclosure to use roller guiding elements to support the yarn guidance rod for axial guidance. With this type of mounting it is a disadvantage that the yarn guidance rod which is moved back and forth at very high speed and may be over 30 meters long must accelerate the mass of the roller guidance elements in addition to its own mass. The savings in mass which is obtained on the one hand by using plastics is cancelled out again on the other hand due because of these roller guidance elements to be accelerated.

DE 3434027 A1 proposes a plain bearing to support the yarn guidance rod. To avoid disadvantages due to the uneven surface of the extruded profile, bearing elements which interact with bearing elements mounted on the machine are mounted on this yarn guidance rod. This has again the disadvantage that additional components must be accelerated.

This DE 3434027 A1 furthermore discloses that yarn guidance rods consisting of extruded profiles containing fibers reinforced with artificial resins, carbon fibers among others. These carbon fiber-reinforced rods possess a high degree of static and dynamic strength and little heat expansion. The heat expansion is especially very low when the fibers are oriented in stretched form in the longitudinal direction in the fiber guidance rod. This low degree of heat expansion is produced in a disadvantageous manner in that heat expansion is very different for the yarn guidance rod and for the machine frame which is normally made of steel. This difference in heat expansion causes a lateral offset in winding the yarn on the cross-wound bobbin, especially when starting up a cold machine until it reaches its heated state. In extreme situations the yarn falls off from the bobbin on the side as it is wound up and prevents orderly build-up of the bobbin.

Yarn guidance rods with fibers in the longitudinal direction of the yarn guidance rod also have the disadvantage that the required transversal strength, i.e the strength concerning forces in radial direction in relation to the cross-section of the yarn guidance rod, is no longer sufficient, especially at high traversing speeds and with long yarn guidance rods. The rods must therefore have a very large cross-section, as they otherwise cannot withstand the extreme loads.

It is therefore the object of the instant invention to create a yarn guidance rod which ensures orderly bobbin build-up at high traversing speeds.

This object is achieved through the characteristics of claims 1 and 4. The yarn guidance rod according to the invention has carbon fibers which are oriented in the axial direction of time yarn guidance rod. This orientation of the carbon fibers has the advantage that it creates a high degree of surface evenness in axial direction and good bending resistance. The structure of the yarn guidance rod allows for axial plain bearing support. The sheathing of this yarn guidance rod in tangential direction increases the transversal strength and torsion resistance to such an extent that it can sufficiently withstand the occurring forces. The sheathing is advantageously so thin that the original surface structure of the yarn guidance rod is substantially maintained. A carbon fiber fleece has proven to be especially advantageous for the sheathing of the yarn guidance rod. The thin fleece with individual shorter carbon fibers ties the preferably endless carbon fibers arranged in axial direction in such manner that a very high degree of strength of the yarn guidance rod is produced to resist transversal forces.

For the reduction of mass it is advantageous for the yarn guidance rod to be hollow. A round cross-section of the yarn guidance rod produces the best utilization of strength with respect to the mass used.

The carbon fibers oriented in axial direction produce a uniform extruded profile over the length of the yarn guidance rod. As a result the yarn guidance rode can be supported advantageously in an axial plain bearing. No other components are required to support the yarn guidance rod. In this manner a mass of the yarn guidance rod which is needed exclusively to maintain the required strength is advantageously obtained.

It is a disadvantage with a carbon-fiber-reinforced yarn guidance rod with axially oriented carbon fibers that it is practically without heat expansion. Due to the expansion of the textile machine an unwanted offset between textile machine and yarn guidance rod which is to be avoided is produced. The device according to the invention solves the problem in that the yarn guidance rod consists alternately of material with little heat expansion, in particular carbon fiber-reinforced plastic, and of material with strong heat expansion. As a result a heat expansion that is nearly the same as that of the textile machine which is normally made of steel is achieved over the totality of the yarn guidance rod. If the textile machine is subdivided into sections it has been shown to be advantageous for the yarn guidance rod to be made alternately of carbon fiber reinforced plastic and of material with strong heat expansion, in accordance with these sections. The individual segments can alternate within one section or also by sections.

Aluminum has proven to be an advantageous heat-expanding material. The heat expansion coefficient of aluminum is several times greater than that of steel. A compensation for the difference in heat expansion in carbon fiber reinforced plastic and steel can thus be achieved. Furthermore aluminum is relatively light, so that it does not hinder substantially the reduction of the accelerated masses.

A hard anodizing (hard coating) of the aluminum produces a good surface hardness for wear-free mounting of the yarn guidance rod.

It has been shown to be especially advantageous to mount the yarn guidance rod directly in an axial plain bearing. By contrast to the state of the art, no additional components to be accelerated are required. In this instance, the surface, in particular that of the carbon fiber reinforced yarn guidance rod must be as even as possible in axial direction. Polyamide 6 molybdenum sulfide 2 (PA6MOS2) has proven to be a suitable material for the plain bearing. This material allows for a low-friction and low-wear mounting of the carbon fiber reinforced yarn guidance rod as well as of the aluminum yarn guidance rod.

An embodiment of the invention is described below.

Figure 1:
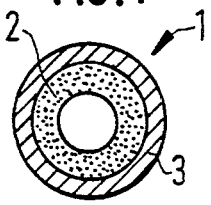
FIG. 1 shows a yarn guidance rod according to the invention, in a cross-section.

FIG. 1 shows a yarn guidance rod 1 according to the instant invention. The yarn guidance rod 1 is provided with a hollow space which is surrounded by carbon fiber reinforced plastic with fibers 2 oriented in a longitudinal direction. The fibers are preferably endless carbon fiber strands. This pipe is produced by extrusion, for example. It is surrounded by a sheathing 3. The sheathing 3 has preferably short fibers which are laid around time body with the fibers 2 in longitudinal direction in form of a thin fiber fleece. These short fibers are imbedded in synthetic resin as are the endless fibers 2 oriented in longitudinal direction. The sheathing of time fibers 2 oriented in longitudinal direction produce outstanding transversal strength and torsion resistance of the yarn guidance rod 1.

Figure 2:
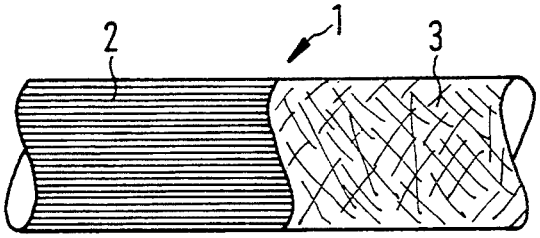
FIG. 2 shows a segment of a partially cut-away yarn guidance rod.

FIG. 2 shows a segment of a yarn guidance rod 1. The yarn guidance rod 1 is shown partially cut away so that the structure of the individual layers of the yarn guidance rod 1 are visible. In one part of the segment of the yarn guidance rod 1 the fibers 2 oriented in time longitudinal direction are shown. These fibers are bonded together with synthetic resin. They form a uniform surface in the longitudinal direction. These fibers 2 oriented in time longitudinal direction are surrounded by the fiber fleece in sheathing 3.

The fiber fleece contains short non-oriented fibers and is preferably very thin. As a result the mass of the yarn guidance rod is not increased substantially. Furthermore the thin fiber fleece causes the surface structure of the body of the yarn guidance rod with the fibers 2 oriented in the longitudinal direction to essentially continue constituting the yarn guidance rod.

Figure 3:
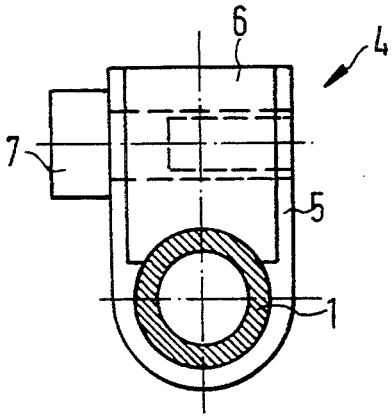
FIG. 3 shows a bearing of a yarn guidance rod.

FIG. 3 shows an axial plain bearing of a yarn guidance rod 1 according to the invention. The axial bearing 4 which is permanently attached to the machine consists of a support 5 and a cover 6. The support 5 and the cover 6 are connected to each other by means of a screw 7. The two joined parts, support 5 and cover 7, constitute a cavity in which the yarn guidance rod 1 can be traversed. The cavity and the yarn guidance rod are provided with a clearance fit. As a result, static friction is reduced to a minimum and the yarn guidance rod 1 is moved as loosely as is necessary for the precise laying of the yarn on the cross-wound bobbin. PA6MOS2 has proven to be an especially advantageous material for the axial bearing.

Figure 4:
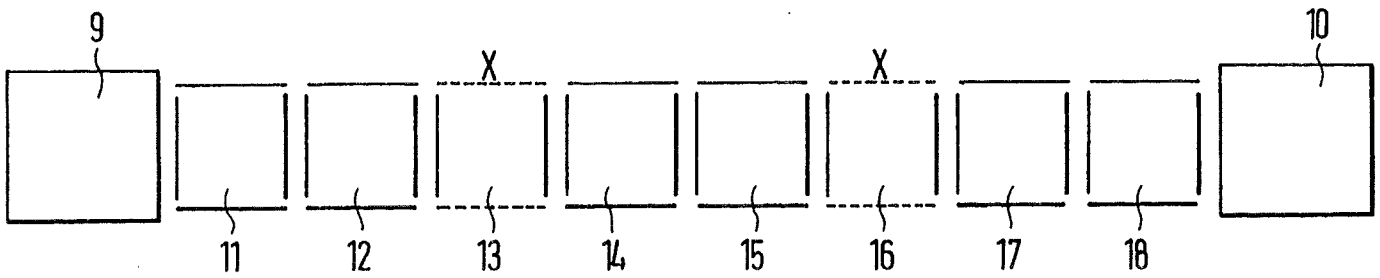
FIG. 4 shows the section structure of a textile machine

A textile machine 8 built up in sections is sketched in FIG. 4. Sections 11 to 18 are installed between a drive stock 9 and an end stock 10. The yarn guidance rod 1 is driven in the drive stock 9. To adapt the heat expansion of the yarn guidance rod 1 to the textile machine 8 it has shown to be advantageous for the yarn guidance rod to be made of highly heat-expanding aluminum in every third section 13 and 16. This division has been shown to be an advantageous compromise between reduction of the mass and strength of the yarn guidance rod 1 in combination with time required heat expansion. With this division between carbon fiber reinforced plastic and aluminum, an expansion of the yarn guidance rod 1 from start of operation of the textile machine 8, i.e. from the cold state of the machine, until normal operation, i.e. the warm state of the machine, is achieved in the sense that no substantial offset is produced at the forward sides of the cross-wound bobbin as the yarn is being wound up.

Depending on the structure of the textile machine 8 and the materials used for the yarn guidance rod 1, the yarn guidance rod can be divided differently into materials with little and strong heat expandability.

We claim:

1. A yarn guidance rod system for use in laying yarn on a cross-wound bobbin on a textile machine, said system comprising a rod having an inner component of carbon fibers oriented substantially in the axial direction of said rod; and a fiber fleece surrounding said inner carbon fiber component, said fiber fleece comprising short individual fibers non-uniformly and randomly embedded in a resin material so as to lie substantially across said inner component carbon fibers, said fleece being relatively thin so that the surface configuration of said inner component is maintained.

2. The yarn guidance rod as in claim 1, wherein said fiber fleece comprises a sheathing of carbon fiber fleece.

3. The yarn guidance rod as in claim 1, wherein said rod is substantially hollow.

4. The yarn guidance rod as in claim 1, wherein said carbon fiber inner component comprises a carbon fiber reinforced plastic.

5. The yarn guidance rod as in claim 1, further comprising axial plain bearings disposed for supporting said rod along the textile machine.

6. The yarn guidance rod as in claim 5, wherein said axial plain bearings are made of polyamide 6 molybdenum sulfide 2.

* * * * *